US007793599B2

(12) United States Patent
Truksa

(10) Patent No.: US 7,793,599 B2
(45) Date of Patent: Sep. 14, 2010

(54) DEVICE FOR POSITION LOCKING OF FOLDING MODULAR SYSTEMS

(76) Inventor: Pavel Truksa, bratři Křičků 3, 621 00 Brno (CZ)

( * ) Notice: Subject to any disclaimer, the term of this patent is extended or adjusted under 35 U.S.C. 154(b) by 929 days.

(21) Appl. No.: 10/556,480

(22) PCT Filed: May 14, 2004

(86) PCT No.: PCT/CZ2004/000028

§ 371 (c)(1),
(2), (4) Date: Dec. 28, 2006

(87) PCT Pub. No.: WO2004/100712

PCT Pub. Date: Nov. 25, 2004

(65) Prior Publication Data

US 2007/0163474 A1 Jul. 19, 2007

(30) Foreign Application Priority Data

May 16, 2003 (CZ) ..... PUV2003-14248

(51) Int. Cl.
*A47B 9/00* (2006.01)

(52) U.S. Cl. ..... 108/145; 248/421

(58) Field of Classification Search ..... 108/7, 108/9, 10, 145, 147, 144.11; 254/122, 124; 248/421, 178.1, 157, 577, 575, 588
See application file for complete search history.

(56) References Cited

U.S. PATENT DOCUMENTS 2,531,140 A * 11/1950 Linde ..... 108/145
2,630,359 A * 3/1953 Schade ..... 108/145
2,728,621 A * 12/1955 Kempter ..... 108/145
3,179,072 A * 4/1965 Coriell ..... 108/145
3,745,935 A * 7/1973 Douglas ..... 108/145
4,073,240 A * 2/1978 Fly ..... 108/145
4,577,772 A 3/1986 Bigliardi
4,817,220 A * 4/1989 Guttormsem ..... 108/145
4,985,602 A * 1/1991 Kouhia ..... 108/9
5,601,014 A * 2/1997 Stevens et al. ..... 108/9
5,632,209 A * 5/1997 Sakakibara ..... 108/145
5,649,493 A * 7/1997 Blume ..... 108/145
7,374,137 B2 * 5/2008 Staney ..... 108/145

FOREIGN PATENT DOCUMENTS

DE 102 32 261 A1 2/2003
WO 94 20699 9/1994

OTHER PUBLICATIONS

World Intellectual Property Office, International Search Report in Corresponding PCT Application No. PCT/CZ2004/000028; Date of Mailing: Oct. 5, 2004 (2 pages).

* cited by examiner

*Primary Examiner*—José V Chen
(74) *Attorney, Agent, or Firm*—Wood, Herron & Evans, LLP

(57) ABSTRACT

Device for position locking of folding modular systems, in particular mobile structures, containers, shelves, means of transport etc., comprising substantially parallel planar units of which at least one bears a jointed tilting frame accommodating, at a distance from the tilting axis, at least one arm whose other end swivels upon one of the planar units. The length of arm (5) is adjustable and its position can be locked.

22 Claims, 2 Drawing Sheets

DEVICE FOR POSITION LOCKING OF FOLDING MODULAR SYSTEMS

FIELD OF THE INVENTION

The technical solution relates to a device for position locking of folding modular systems, in particular mobile structures, containers, shelves, means of transport etc., comprising substantially parallel planar units of which at least one bears a jointed tilting frame accommodating, at a distance from the tilting axis, at least one arm whose other end swivels upon one of the planar units.

BACKGROUND OF THE INVENTION

The Czech utility model No 3909 discloses a folding modular system, in particular for mobile structures, shelves, bodies and upper structures of automobiles and trailers consisting of at least two mechanically linked and substantially parallel basic planar units, frames or boards, where at least one of the basic planar units accommodates at least one turnable tilting frame bearing, at a distance from the turning axis, at least one arm whose opposite end also swivels on the basic planar unit. The sense of rotation of the axes at least two of the tilting frames can be preferably different. The tilting frames accommodated between a pair of basic planar units can swivel upon by different basic planar units. In a preferable embodiment a pair of adjacent basic planar units can be connected with a pair of tunably linked tilting frames of which each swivels upon one of the adjacent basic planar units. The shape of the basic planar units can be polygonal. The tilting and/or tipping frames can have flat fills and/or can be filled with boards.

The mentioned solutions do not achieve fully safe and timely undemanding locking of the folding system against spontaneous tipping immediately after the erection, before the system is fully rigid.

It is the aim of the present technical solution to create a simple folding modular system of the above mentioned type, allowing also multi-floor executions and achieving high stability immediately after the erection and a fast, easy, and safe installation.

SUBSTANCE OF THE INVENTION

The object of the device for position locking of folding modular systems, in particular mobile structures, containers, shelves, means of transport etc., comprising substantially parallel planar units of which at least one bears a jointed tilting frame accommodating, at a distance from the tilting axis, at least one arm whose other end swivels upon one of the planar units according to this technical solution resides in that the length of this arm is adjustable and its position can be locked.

A particular ease is offered by an embodiment wherein the arm is created by an upper part attached by joint to the tilting frame, a central part and a bottom part attached by joint to the bottom planar unit, where the upper part, the central part and the bottom part are fixed together by screws with different sense of the threads and the central part is provided with swivelling means, these swivelling means being created as a polygonal outer surface of the central part, or an opening for receiving a control lever.

According to another embodiment that is especially preferable for fast installation, the arm is created by an upper part and a bottom part that mesh telescopically, and at least one is arranged for position locking, while a pressure spring can be inserted between the upper part and the bottom part.

An especially rigid fixation is enabled by an embodiment where the arm is arranged in the internal space of the lateral walls of the tilting frame whose profile forms a cavity, the bottom part tilting in a holder that is firmly fixed to the bottom planar unit where, if the tilting frame assumes perpendicular position with regard to the bottom planar unit, it partially protrudes into the bottom part of the cavity of the lateral wall of the tilting frame, and further also an embodiment according to which the arm is created by the upper part attached by joint to the tilting frame, whereas the bottom part is arranged in the bottom planar unit so as to be adjustable and lockable in its position, while the upper part and the bottom part have mutual tilting connection.

It is another preferable feature of this embodiment that the bottom part comprises a bushing attached to the bottom planar unit, the cavity of the bushing accommodating a holder to which the upper part is attached in a hinge, said holder being provided with an internal thread for a counter-rotating adjusting screw.

DESCRIPTION OF THE DRAWINGS

The technical solution is described in the following by way of an example of a collapsible container, using the attached diagrammatic drawings wherein.

EXAMPLES OF EMBODIMENT OF THE TECHNICAL SOLUTION

Figure 1:
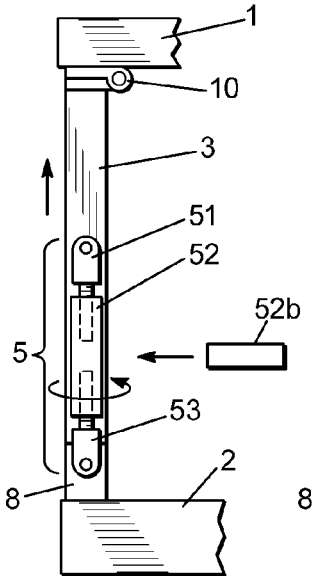
FIG. 1 shows a partial diagrammatic view of the mutual arrangement of the tilting frame, the upper and the bottom planar unit and the arm in upright and locked condition, FIG. 2 an embodiment according to FIG. 1 in the initial phase of folding down to the transport position, FIG. 3 an embodiment according to FIG. 1 in position prior to collapsing the container, i.e. to the folding down position for transport or storage, FIG. 4 an embodiment using an arm on the basis of the telescopic execution, FIGS. 5 and 6 another embodiment with telescopic arm, however, complemented with a spring, FIG. 7 an embodiment according to FIGS. 1 and 2, yet with the arm arranged in the internal space of the cavity of the lateral wall of the tilting frame, shortly before the erection and the securing of the container, FIG. 8 an embodiment according to FIG. 7 in the erected and already locked condition, FIG. 9 a view of another execution of the arm, and FIG. 10 the bottom part of the arm in execution according to FIG. 9 in a larger scale.

Considering the fact that foldable modular systems that are improved by the present technical solution are principally described in a detailed way in the above state of technology, the following description focuses upon the substantial features of the technical solution used in a foldable container wherein the upper planar unit 1 is the upper wall, the bottom planar unit 2 the foundation and the tilting frame 3 is one of the lateral walls attached in hinge 10. The previous rigid arm is replaced with the arm 5 whose length is adjustable and the adjusted length can be locked. The arm 5 has tipping attachment, on one hand, to tilting fame 3 creating, in the given case, one of the walls of the foldable container, on the other hand on the bottom planar unit 2—the foundation, in the given case by way of holder 8.

Figure 7:
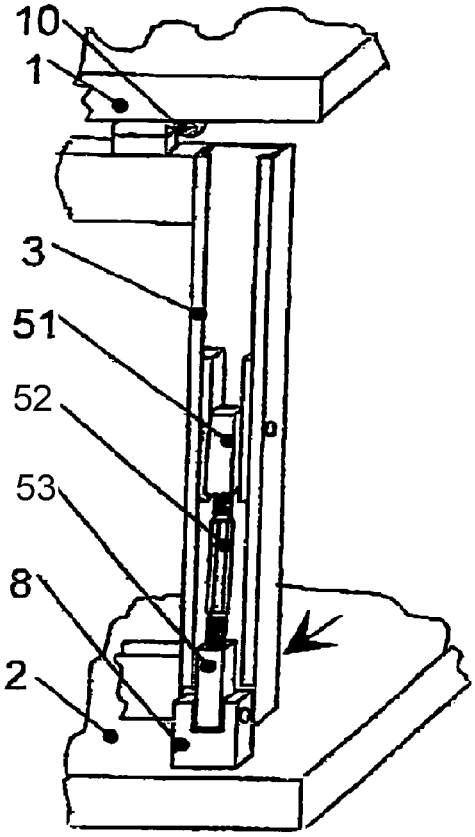
Figure 8:
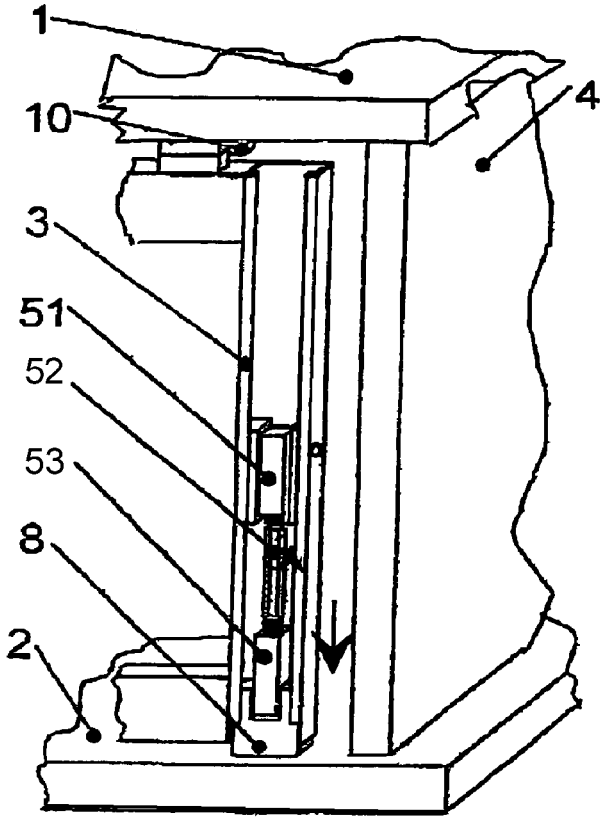

The arm 5 consists of the upper part 51, the central part 52 and the bottom part 53, the mentioned parts being fastened to one another with screws having counter-threads, and the central part 52 is provided with a polygonal surface for the purpose of swivelling, as obvious from FIGS. 7 and 8, or possibly with a not illustrated opening for accommodating a suitable control lever 52*b*, all that for the purpose of achieving a variable length of arm 5. The adjusted length of arm 5 can be locked with not illustrated means, such as a sunk screw /stud.

Figure 4:
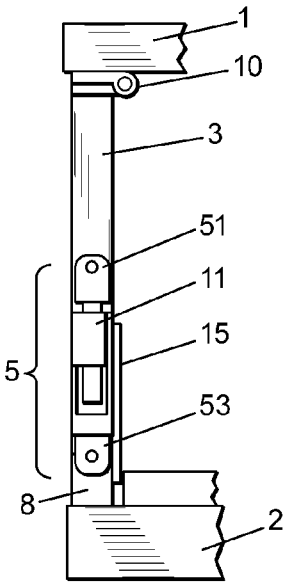
Figure 5:
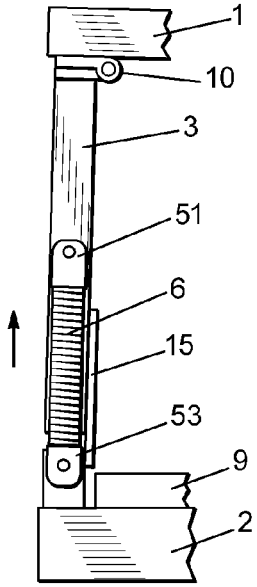
Figure 6:
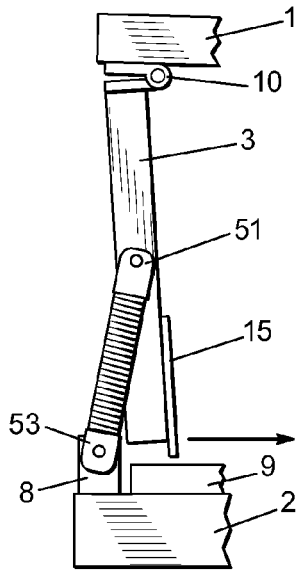

In the embodiment according to FIGS. 4, 5 and 6 the arm 5 is formed by upper part 51 and bottom part 53 that mesh telescopically, at least one of them being also provided with position locking 7 created by a hole for a pin or screw.

An embodiment according to FIGS. 5 and 6 comprises a pressure spring 6 that is inserted between the upper part 51 and bottom part 53.

Figure 2:
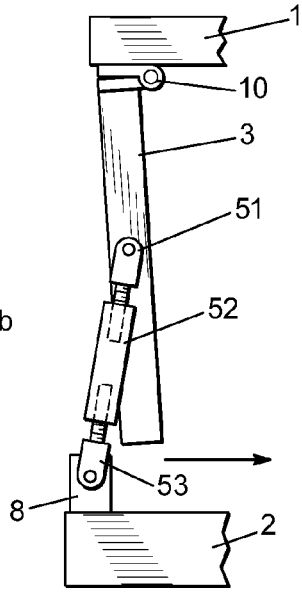
Figure 3:
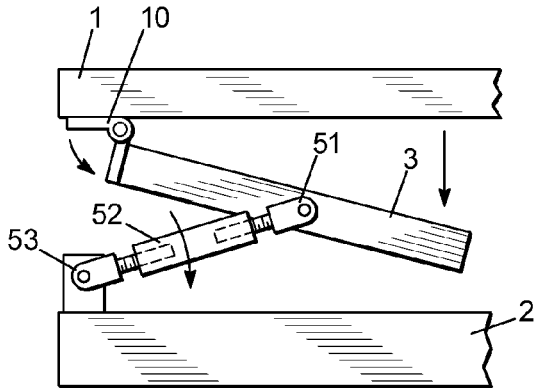

In embodiments according to FIGS. 7 and 8 the arm 5 is analogous with FIGS. 1 through 3 with the difference that it is arranged in the internal space of the lateral walls of tilting frame 3 with cross section profile of the C shape, with a longitudinal open cavity. Such modification allows, as soon as the perpendicular position of tilting frame 3 with respect to the bottom planar unit 2 is achieved, to push holder 8 partially into the bottom part of the cavity of the lateral wall of tilting frame 3 as obvious in FIG. 8. This improves the rigidity of the erected container.

Figure 9:
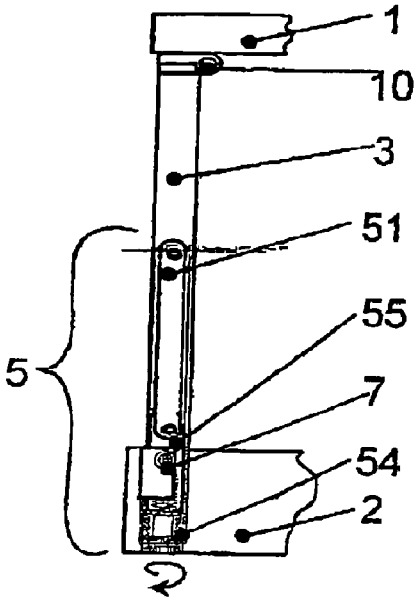
Figure 10:
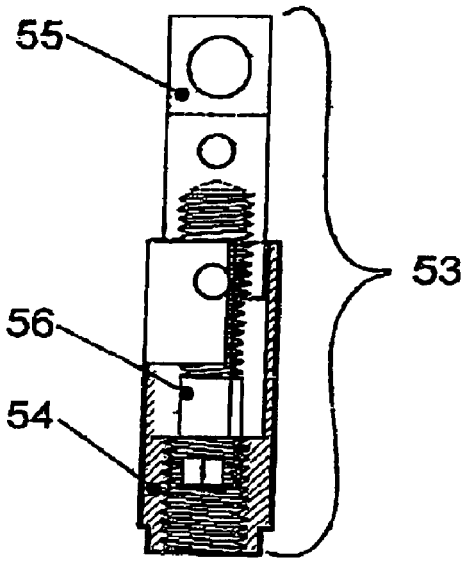

According to the embodiment illustrated in FIGS. 9 and 10 the arm 5 consists of the upper part 51 attached by joint to tilting frame 3, and a bottom part 53 arranged within the bottom planar unit 2 so as to achieve an adjustable and lockable position, the upper part 51 and the bottom part 53 having tilting connection.

The bottom part 53 comprises the bushing 54 attached to the bottom planar unit 2, while in the cavity of bushing 54 a holder 55 is arranged carrying the tilting upper part 51 and is provided with an internal thread for the counter-rotating adjusting screw 56.

Such embodiment is particularly beneficial in cases requiring the adjustment and locking of the arms from under the container that is above the level with respect to the terrain The function of the above devices is as follows: Although only the procedure during folding of the container into the transport or storage condition has been described, the analogous opposite procedure should be used for its erecting.

First of all the arms 5 should be lengthened to the position allowing to remove any lining, if applicable, and any partitions, e.g. partition wall 4 that was firmly held by the upper and bottom planar units 1 and 2 in installed condition, especially under the effect of the described arms 5. That is why after the already described position lock of arms 5 is removed, the arms are elongated and the folding process of one or more tilting frames 3—the walls—the container, begins in the sense indicated by arrow in FIG. 2, through the position illustrated in FIG. 3, down to complete folding down of the container into the position for transport or storage. During this procedure the upper planar unit 1 is suspended and can be lowered with an appropriate mechanism, such as a mobile crane.

The described solution is relatively simple and integrates all necessary means in compact entities, without the necessity of using any auxiliary equipment. It allows fast and safe erection and folding down.

The technical solution is by no means limited to the described example of embodiment and can be used also for multi-floor systems.

LIST OR REFERENCE NUMERALS

1 upper planar unit
2 lower planar unit
3 tilting frame
4 position wall
5 arm
  51 upper part
  52 central part
  53 bottom part
  54 bushing
  55 holder
  56 adjusting screw
6 pressure spring
7 position locking
8 holder
9 board
10 hinge

The invention claimed is:

1. An apparatus for locking the relative position of first and second generally planar structures that are generally parallel to one another, the first and second generally planar structures having a collapsed condition in which they are spaced from one another by a first distance and a deployed condition in which they are spaced from one another by a second distance greater than the first distance, the apparatus comprising:

an elongated frame member having first and second ends, said first end of said elongated frame member configured to be pivotally coupled to the first generally planar structure; and an elongated arm having a plurality of portions and first and second ends, said first end of said elongated arm being pivotally coupled to said elongated frame member and said second end of said elongated arm configured to be pivotally coupled to the second generally planar structure, wherein:

said elongated frame member and said elongated arm are generally coaxial and transverse to the first and second generally planar structures in the deployed condition of the first and second generally planar structures, and the length of said elongated arm is adjustable by relative movement of said plurality of portions along the length of said elongated arm to thereby selectively lock and unlock said elongated frame member relative to the second generally planar structure.

2. The apparatus of claim 1, wherein said elongated arm includes first and second portions that mesh telescopically, at least one of said first or second portions being configured for position locking.

3. The apparatus of claim 2, further comprising a compression spring disposed between said first and second portions.

4. The apparatus of claim 1, wherein said first end of said elongated arm is slidingly coupled to said elongated frame member.

5. The apparatus of claim 1, wherein said elongated arm includes a pair of end portions coupled to a central portion disposed between said end portions.

6. The apparatus of claim 5, wherein the length of said elongated arm is adjustable by rotating said central portion relative to said end portions.

7. The apparatus of claim 6, wherein said central portion is coupled to said end portions through respective first and second threaded elements having their respective threads running in directions opposite one another.

8. The apparatus of claim 5, wherein said end portions are movable relative to said central portion along the length dimension of said elongated arm.

9. The apparatus of claim 5, wherein said central portion has a polygonal outer surface.

10. The apparatus of claim 5, wherein said central portion includes an opening configured to receive a control lever therein for selectively adjusting the length of said elongated arm.

11. The apparatus of claim 1, further comprising:

a locking element for selectively locking the selected length of said elongated arm.

12. The apparatus of claim 11, wherein said locking element includes at least one of a pin, a screw, or a stud.

13. The apparatus of claim 1, wherein said elongated frame member includes a pair of lateral walls defining a channel therebetween, said elongated arm being disposed within said channel in the deployed condition of the first and second generally planar structures.

14. The apparatus of claim 13, wherein said second end of said elongated arm is configured to be pivotally coupled to the second generally planar structure through a holder extending from a surface of the second generally planar structure, said elongated frame member being slidably movable relative to said holder so as to receive said holder within said channel.

15. The apparatus of claim 1, wherein said second end of said elongated arm is configured to be pivotally coupled to the second generally planar structure through a holder extending from a surface of the second generally planar structure, said second end of said elongated arm and said holder having respective flat surfaces, elongation of said elongated arm being effective to move said flat surfaces into an abutting relationship with one another.

16. The apparatus of claim 1, wherein said second end of said elongated arm is configured to be pivotally coupled to the second generally planar structure through a holder extending from a surface of the second generally planar structure, said second end of said elongated frame member and said holder having respective flat surfaces, elongation of said elongated arm being effective to move said flat surfaces into an abutting relationship with one another.

17. The apparatus of claim 1, further comprising:

a bushing having a cavity and a holder received within said cavity, said second end of said elongated arm configured to be pivotally coupled to the second generally planar structure through said holder, said bushing being disposed within an interior of the second generally planar structure and said holder having an internally threaded surface configured to receive a screw for selectively adjusting the length of said elongated arm.

18. A modular construction, comprising:

first and second generally planar structures that are generally parallel to one another, said generally planar structures having a collapsed condition in which they are spaced from one another by a first distance and a deployed condition in which they are spaced from one another by a second distance greater than the first distance; and an apparatus for locking the relative position of said first and second generally planar structures in the deployed condition, the apparatus including:

an elongated frame member having first and second ends, said first end of said elongated frame member being pivotally coupled to said first generally planar structure, and an elongated arm having a plurality or portions and first and second ends, said first end of said elongated arm being pivotally coupled to said elongated frame member and said second end of said elongated arm being pivotally coupled to said second generally planar structure, wherein:

said elongated frame member and said elongated arm are generally coaxial and transverse to said first and second generally planar structures in the deployed condition of said first and second generally planar structures, and the length of said elongated arm is adjustable by relative movement of said plurality of portions along the length of said elongated arm to thereby selectively lock and unlock said elongated frame member relative to said second generally planar structure.

19. The modular construction of claim 18, wherein said elongated frame member and said elongated arm are substantially perpendicular to said first and second generally planar structures in the deployed condition thereof.

20. The modular construction of claim 18, wherein said second end of said elongated arm is pivotally coupled to said second generally planar structure through a holder extending from a surface of said second generally planar structure, said second end of said elongated arm and said holder having respective flat surfaces, elongation of said elongated arm being effective to move said flat surfaces into an abutting relationship with one another.

21. The modular construction of claim 18, wherein said second end of said elongated arm is pivotally coupled to said second generally planar structure through a holder extending from a surface of said second generally planar structure, said second end of said elongated frame member and said holder having respective flat surfaces, elongation of said elongated arm being effective to move said flat surfaces into an abutting relationship with one another.

22. The modular construction of claim 18, further comprising:

a bushing having a cavity and a holder received within said cavity, said second end of said elongated arm being pivotally coupled to said second generally planar structure through said holder, said bushing being disposed within an interior of said second generally planar structure and said holder having an internally threaded surface configured to receive a screw for selectively adjusting the length of said elongated arm.

* * * * *